US008190044B2

(12) United States Patent
Kitamura et al.

(10) Patent No.: US 8,190,044 B2
(45) Date of Patent: May 29, 2012

(54) IMAGE FORMING APPARATUS

(75) Inventors: Takuya Kitamura, Numazu (JP); Kohei Matsuda, Suntou-gun (JP); Hideaki Hasegawa, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 349 days.

(21) Appl. No.: 12/548,708

(22) Filed: Aug. 27, 2009

(65) Prior Publication Data

US 2010/0054780 A1 Mar. 4, 2010

(30) Foreign Application Priority Data

Aug. 29, 2008 (JP) ..... 2008-221986
Aug. 29, 2008 (JP) ..... 2008-222002
Aug. 24, 2009 (JP) ..... 2009-193682

(51) Int. Cl.
*G03G 15/06* (2006.01)

(52) U.S. Cl. ..... 399/55; 399/285

(58) Field of Classification Search ..... 399/55, 399/285

See application file for complete search history.

(56) References Cited

U.S. PATENT DOCUMENTS 4,286,543 A 9/1981 Ohnuma et al. ..... 118/657
5,086,728 A 2/1992 Kinoshita ..... 118/653
5,253,022 A 10/1993 Takeuchi et al.
5,416,567 A 5/1995 Toyoshima et al. ..... 355/259
5,761,590 A * 6/1998 Sato ..... 399/285
7,317,889 B2 1/2008 Suzuki ..... 399/236
2007/0098459 A1 * 5/2007 Endo et al. ..... 399/281

FOREIGN PATENT DOCUMENTS

JP 62-223771 10/1987
JP H03-125169 5/1991
JP H07-114261 5/1995

* cited by examiner

*Primary Examiner* — Constantine Hannaher
(74) *Attorney, Agent, or Firm* — Fitzpatrick, Cella, Harper & Scinto

(57) ABSTRACT

An image forming apparatus includes an image bearing member for bearing an electrostatic latent image; a developing device including a developer carrying member for carrying a developer and developing an electrostatic latent image formed on the image bearing member, and a supplying member for contacting to the developer carrying member to supply the developer to the developer carrying member; and a control device for controlling Vdr and Vrs such that Vrs relative to Vdr increases in a direction of a polarity which is the same as a polarity of the developer with the decrease of an absolute value S, where S is a difference between a peripheral speed Sopc of a surface of the image bearing member and a peripheral speed Sdr of the surface of the developer carrying member, Vrs is a voltage applied to the supplying member, and Vdr is a voltage applied to the developer carrying member.

9 Claims, 7 Drawing Sheets

IMAGE FORMING APPARATUS

FIELD OF THE INVENTION AND RELATED ART

The present invention relates to an image forming apparatus, such as a copying machine, a printer, etc., which employs an electrophotographic image forming method or an electrostatic image recording method.

As one of the developing methods employed by an electrophotographic apparatus, such as a printer, a copying machine, etc., to develop a latent image, there is a so-called contact developing method, which is disclosed in Japanese Laid-open Patent Application 62-223771. This developing method develops a latent image by placing developer in contact with an image bearing member.

This developing method makes it possible to output a high quality color image. Thus, there have been proposed various developing apparatuses based on this developing method. Regarding the structure of a developing apparatus of this type, the developing apparatus of this type has: a developer supplying member for supplying a developer bearing member with nonmagnetic single-component developer (toner); a stirring member for conveying the developer to the adjacencies of the developer supplying member while stirring the developer; and a regulating member for regulating the amount by which the developer is allowed to remain on the developer bearing member.

One of the examples of developer supplying member is disclosed in U.S. Pat. No. 5,086,728. In the case of this patent, in order to ensure that developer remains stable in the characteristics of its electric charge, a sponge roller is employed to provide a developer bearing member with a fresh supply of developer while scraping away the developer remaining on the developer bearing member.

Further, there have been proposed developing apparatuses which vary a developer supplying member in potential level according to image duty. One of these developing apparatuses is disclosed in Japanese Laid-open Patent Application H07-114261.

In the case of the image forming apparatus disclosed in Japanese Laid-open Patent Application H03-125169, in order to stabilize developer in terms of the amount of electric charge, a blade bias power source is connected to the regulating member, and a blade bias is applied to the development blade to charge the developer to a preset potential level. There are various blade bias power sources. That is, some of them supply the development blade with a potential which is the same in level as the potential with which a development roller is provided by a development bias power source, whereas the others supply the development blade with various potentials which are different in level from the potential with which a development roller is provided by a development bias power source.

It should be noted here that it is possible to facilitate the transfer of normally charged toner particles onto the developer bearing member, while preventing undesirable toner particles (reversely charged toner particles) from transferring onto the developer bearing member, by applying to a regulating member a voltage which is the same in polarity as the charge of the developer (toner), as disclosed in U.S. Pat. No. 5,416,567. Further, the application of a voltage, which is the same in polarity as the charge of the developer (toner), to a regulating member can prevent toner from reducing in specific charge, and therefore, it can prevent toner particles from falling in a lump and/or formation of a foggy image.

Further, it has been proposed in U.S. Pat. No. 4,286,543 to cause the peripheral surface of a developer bearing member and the peripheral surface of an image bearing member to move relative to each other in the area of contact between the two members, to create friction between the two members so that not only the amount, by which an image bearing member is supplied with developer, is increased, but also, the byproducts of corona, which generate on the peripheral surface of the image bearing member, and the toner particles (developer), which are weak in adhesive force, are mechanically removed from the peripheral surface of the image bearing member.

In recent years, an image forming apparatus, such as a printer, a copying machine, and the like, has come to be required to deal with a variety of printing media. Thus, a recent image forming apparatus is enabled to operate at the optimal speed for the printing medium.

However, changing an image forming apparatus in printing speed while keeping the same peripheral speed ratio between its image bearing member and developer bearing member changes in absolute value the peripheral velocity difference between the image bearing member and developer bearing member, as described in U.S. Pat. No. 4,286,543 mentioned above. Further, the studies made by the inventors of the present invention confirmed that the smaller the absolute value S of the peripheral velocity difference between the image bearing member and developer bearing member reduced, the greater the amount of fog, as shown in FIG. 2 appended to this application. A problem similar to this problem has been described in U.S. Pat. No. 7,317,889.

As one of the means for avoiding the occurrence of this problem, it can be listed to prevent the fog formation by setting in advance the abovementioned peripheral velocity ratio in such a manner that even if a printer is changed in printing speed, a substantial amount of difference in peripheral velocity is maintained in terms of absolute value.

In recent years, however, image forming apparatuses, such as a copying machine, have been significantly increased in operational speed, and therefore, a developer bearing member has been significantly increased in peripheral velocity. Thus, it has become possible that the developer bearing member would deteriorate in the area of contact between the developer bearing member and developer seal portion, which in turn would cause the developer seal to fail. Thus, a greater amount of attention has to be paid to the peripheral velocity of the developer bearing member.

Further, it has been confirmed, by the studies made by the inventors of the present invention, that as the potential level difference V (=Vrs−Vdr) between the developer bearing member and developer supplying member is increased while being kept the same in polarity as the developer, highly charged developer particles (toner particles) on the developer supplying member are selectively supplied to the developer bearing member, and therefore, the developer particle distribution (toner particle distribution) in terms of the amount of charge is shifted toward the same direction as the developer polarity, as shown in FIG. 3 appended to this application.

The above-described methods are effective to prevent the formation of foggy images. It has been confirmed, however, that as the potential level difference V is increased while being kept the same in polarity as the developer, the amount by which the developer remaining on the developer bearing member is stripped away by the developer supplying member reduces, as shown in FIG. 4 appended to this application. Thus, if an image forming apparatus (printer) of the contact development type is operated while being set so that the peripheral velocity difference is large in absolute value, and the potential level difference V is set to a value which makes smaller the amount by which the residual developer on the developer bearing member, that is, the developer remaining on the developer bearing member, is stripped away by the developer supplying member, it is possible that the portion of the residual developer, which the developer supplying member fails to strip away from the developer bearing member, will deteriorate and solidly adhere to the developer bearing member.

Further, the following has been revealed by the studies made by the inventors of the present invention. That is, as the potential level difference V' (=Vdb−Vdr) between the developer bearing member and developer regulating member is increased in absolute value while being kept the same in polarity as the developer (toner), as shown in FIG. 6 appended to this application, the greater the amount of normal charge each toner particle has, the greater the force by which the toner particle is pushed toward the developer bearing member. Therefore, it is easier for the normally charged toner particle to be conveyed by the developer bearing member, and the unsatisfactory charged toner particle, that is, toner particle charged to the opposite polarity from the normal polarity, is trapped by the developer regulating member.

Therefore, it has been confirmed that if the potential level difference V' is rendered larger while being left in the same polarity as the toner, the distribution of developer (toner) particles on the downstream side of the regulating member, in terms of the rotation of the developer bearing member, substantially shifts toward the same polarity as the toner.

For the prevention of a foggy image, it is effective to promote the transfer of the normally charged toner particles onto the developer bearing member while preventing unsatisfactory toner particles (reversely charged toner particles from transferring onto the developer bearing member.

However, an image forming apparatus, such as those described above, is repeatedly operated at a printing speed at which the peripheral velocity difference is large in absolute value, with the potential level difference V' set to a large value, for a long period of time, the following problem occurs.

That is, it is possible that the toner particles kept pressed upon the developer bearing member, by the strong electric field generated by the potential level difference V', will be made to deteriorate on the developer bearing member, by the mechanical friction generated by the peripheral velocity difference which is large in absolute value, and therefore, will solidly adhere to the developer bearing member.

SUMMARY OF THE INVENTION

Thus, the primary object of the present invention is to provide an image forming apparatus capable of forming high quality images, that is, images which are free of fog, without causing developer to deteriorate, regardless of the absolute value of the peripheral velocity difference between the image bearing member and developer bearing member. More concretely, it is to provided an image forming apparatus characterized in that the bias application control to be executed by the apparatus when the apparatus is operated at a printing speed at which the absolute value of the peripheral velocity difference is at a higher value which makes it unlikely for the apparatus to form a foggy image is made different from the bias application control to be executed by the apparatus when the apparatus in operated at a printing speed at which the absolute value of the peripheral velocity difference is at a lower value which makes it likely for the apparatus to form a foggy image.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the preferred embodiments of the present invention will be described in more detail with reference to the appended drawings.

Embodiment 1

Figure 1:
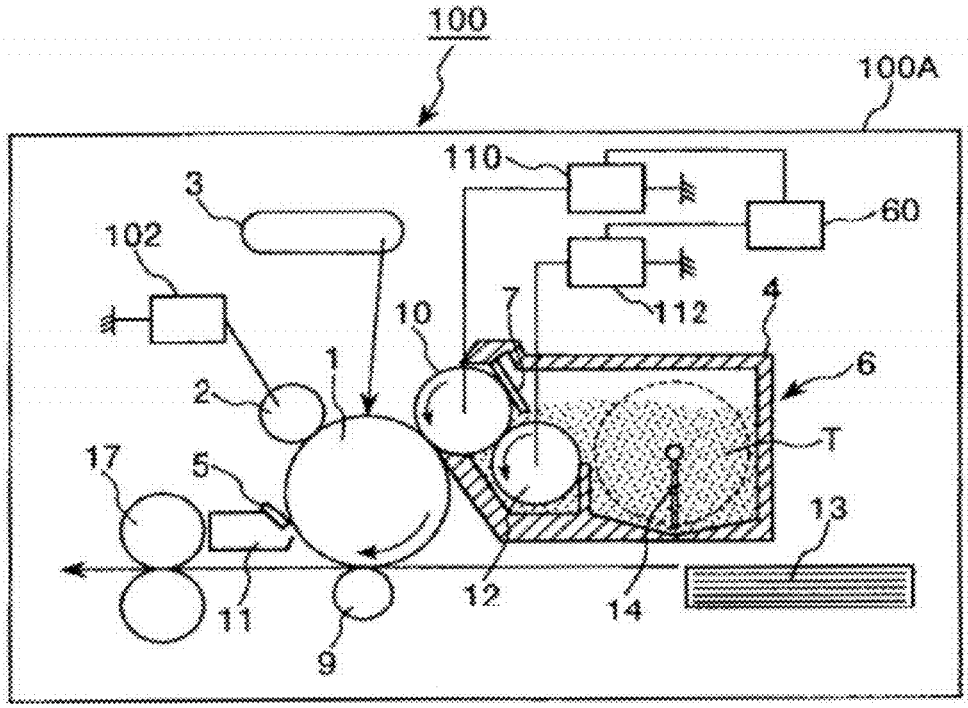
FIG. 1 is a schematic sectional view of the image forming apparatus in the first preferred embodiment of the present invention, and shows the general structure of the apparatus.
Figure 2:
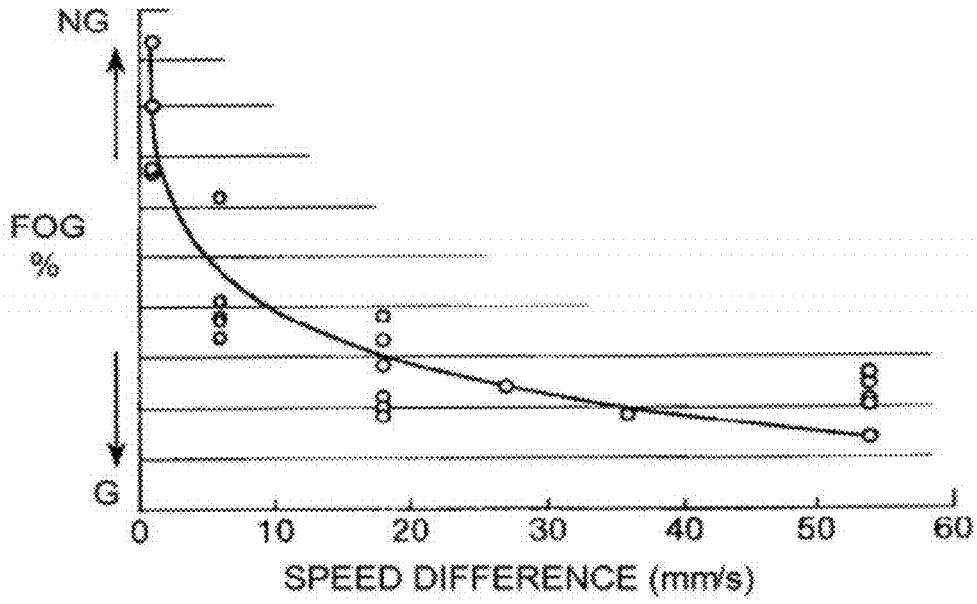
FIG. 2 is a graph which shows the relationship between the absolute value S of the velocity difference, and the fog.
Figure 3:
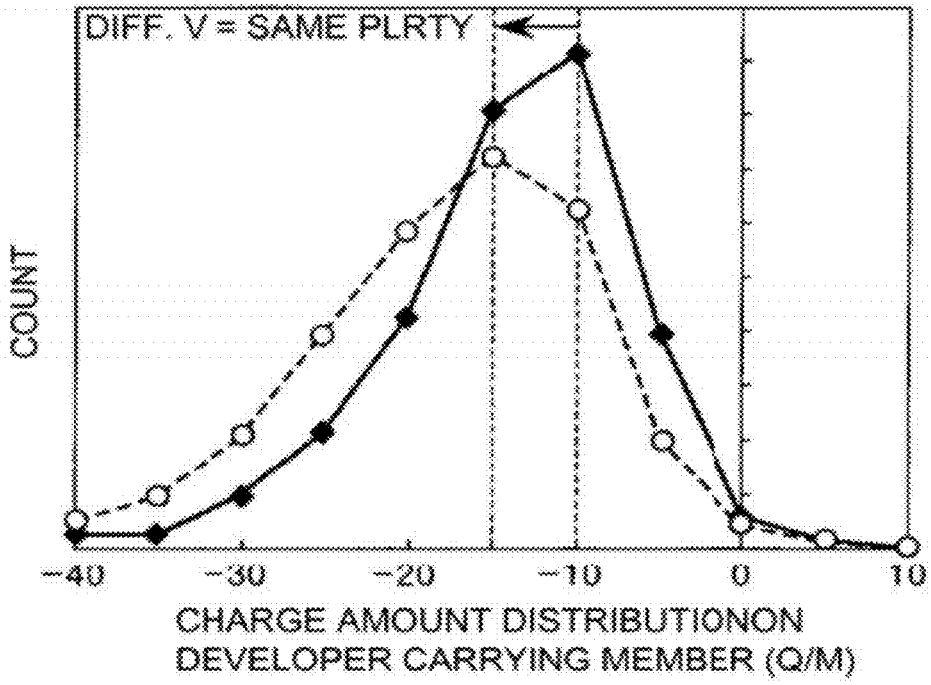
FIG. 3 is a graph which shows the relationship between the potential level difference V and the developer (toner) particle distribution on the developer bearing member in terms of the amount of charge.
Figure 4:
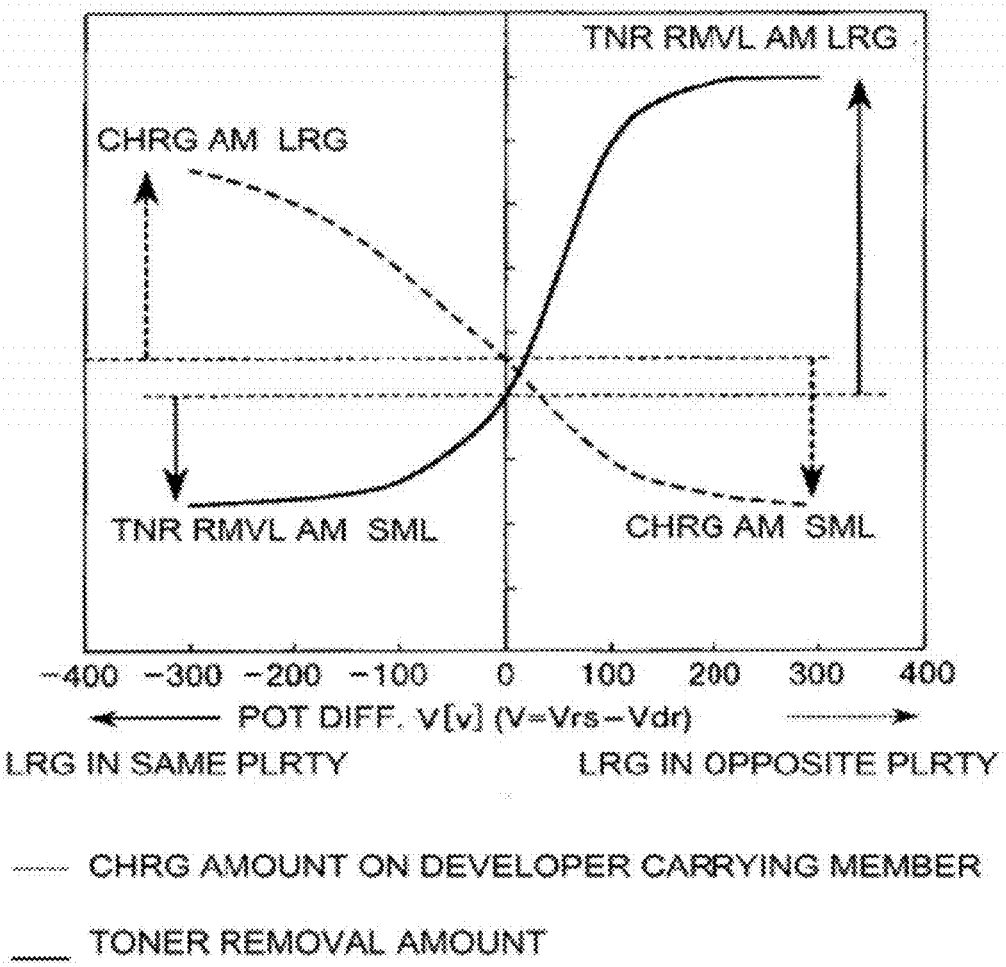
FIG. 4 is a graph which shows the relationships among the potential level difference V, developer (toner) particle distribution on developer bearing member in terms of the amount of charge, and amount by which toner was scraped away from the developer bearing member by the toner supply roller.

Referring to FIG. 1, the image forming apparatus in the first preferred embodiment of the present invention will described.

The image forming apparatus 100 in this embodiment is an electrophotographic image forming apparatus, more specifically, a laser beam printer which employs a developing method of a contact type. It has a cleaning mechanism, and uses nonmagnetic single-component developer.

The image forming apparatus 100 is provided with an electrophotographic photosensitive member 1, as an image bearing member, which is in the form of a drum (which therefore will be referred to as "photosensitive drum" hereafter). The image forming apparatus 100 is also provided with a charging member 2, as a charging means, which is in the adjacency of the peripheral surface of the photosensitive drum. The charging member 2 is in the form of a roller. Therefore, the charging member 2 will be referred to as a charge roller 2 hereafter. The charge roller 2 is of the contact type. To the charge roller 2, a charge bias is applied from a charge roller bias power source apparatus 102. The photosensitive drum 1 in this embodiment is rotationally driven in the clockwise direction by a driving means (unshown). Thus, as the photosensitive drum 1 is rotationally driven, the photosensitive drum 1 is uniformly charged by the charge roller 2.

Further, the image forming apparatus 100 is provided with an exposing apparatus 3 (exposing means which employs beam of laser light) and a developing apparatus 6 (developing means), which are also in the adjacency of the peripheral surface of the photosensitive drum 1. As the photosensitive drum 1 is uniformly charged, the uniformly charged portion of the photosensitive drum 1 is exposed by the exposing apparatus 3. As a result, an electrostatic latent image is effected on the peripheral surface of the photosensitive drum 1. The electrostatic latent image is visualized (developed) by the developing apparatus 6; it is turned into a visible image formed of toner, which therefore may be referred to as a toner image thereafter.

The developing apparatus 6 is provided with a developer container 4, in which developer T is stored. The developing apparatus 6 is also provided with: a developer bearing member 10 which bears the developer T and conveys the developer T thereon to the photosensitive drum 1; a developer regulating member 7 which regulates the amount by which the developer T is allowed to remain per unit area on the developer bearing member 10; and a developer supplying member 12 which supplies the developer bearing member 10 with the developer T. Further, the developing apparatus 6 is provided with a stirring-and-conveying member 14, which is in the developer container 4 and supplies the developer supplying member 12 with the developer T while stirring the developer T in the developer container 4.

The developer bearing member 10 is rotated in such a direction that the direction in which its peripheral surface moves in the area of contact (development portion) between the developer bearing member 10 and photosensitive drum 1 is the same as the direction in which the peripheral surface of the photosensitive drum 1 moves in the area of contact. After the formation of an electrostatic latent image on the photosensitive drum 1, the electrostatic latent image is developed by the developing apparatus 6, into a visible image, that is, a toner image, as described above.

Incidentally, the developer used in this embodiment is made up of a single component. It is nonmagnetic, and its native polarity is negative. The developing apparatus 6 in this embodiment adheres the developer to the exposed points (portions) of the electrostatic latent image; it develops a latent image in reverse.

After the formation of a toner image with the use of the developing apparatus 6 structured as described above, the toner image is transferred by a transfer roller 9 (transferring means) onto a sheet 13 of transfer medium (recording medium). Then, the toner image on the sheet 13 of transfer medium is fixed to the sheet 13 by a fixing apparatus 17. Thereafter, the sheet 13 is discharged from the main assembly 100A of the image forming apparatus 100.

The developer having failed to be transferred onto the sheet 13 of recording medium from the photosensitive drum 1, that is, the developer remaining on the peripheral surface of the photosensitive drum 1 after the transfer of the toner image, is scraped away by a cleaning blade 5, and is stored in a container 11 for waste developer. The cleaned portion of the peripheral surface of the photosensitive drum 1 is charged again by the charge roller 2.

The above-described sequential steps are continuously repeated to complete a single image on the sheet 13 of recording medium.

The developing apparatus 6 in this embodiment may be made in the form of a cartridge (development cartridge) so that it can be removably mountable in the main assembly 100A of the image forming apparatus 100A structured to be compatible with a development cartridge.

Further, the photosensitive drum 1 and at least developing apparatus 6 may be integrated in the form of a process cartridge, which is removably mountable in the apparatus main assembly 10A. Moreover, the charging means, cleaning means, etc., in addition to the photosensitive drum 1 and developing apparatus 6, may be integrally disposed in a cartridge to make a process cartridge.

Next, the developer bearing member 10, which is a preferable develop bearing member for the image forming method in this embodiment, will be described.

There is no restriction regarding the developer bearing member 10, as long as it is usable for an ordinary developing method which uses single-component developer. However, a roller (development roller) having an elastic layer is preferable as the developer bearing member 10. The development roller 10 in this embodiment is of the so-called contact type. That is, the toner borne on the peripheral surface of the development roller 10 directly contacts the photosensitive drum 1.

From the standpoint of the balance between performance and durability, the hardness of the elastic surface layer of the development roller 10 is desired to be in a range of 20-60 degrees (in ASKER C scale). As for the material and structure for the elastic layer of the development roller 10, any of the known substances and any of the known structures are usable. However, solid rubber, such as silicone rubber, urethane rubber, NBR, etc., or foamed versions of the preceding solid rubbers, are preferable. Further, any of the known elastic multilayer rollers, the top layer of which is different in material from the layer under the top layer, may be employed as the development roller 10.

Regarding the texture of the peripheral surface of the development roller 10, from the standpoint of achieving both a high degree of image quality and the longevity for the development roller 10, it is desired to provide the peripheral surface of the development roller with a proper degree of surface roughness. More concretely, it is desired that the development roller 10 be manufactured so that its surface roughness, for example, Ra (μm) (JIS B 0601), is no more than 3.0. That is, a development roller, the peripheral surface roughness of which is no more than 3.0, reliably conveys the developer by a proper amount (preset amount) per unit area. A development roller (10), the surface roughness Ra of which is no less than 3.0, bears too much developer for the developer regulating member 7 to provide the developer with a proper amount of triboelectrical charge. Thus, the employment of such a development roller (10) will possibly result in the formation of an image, the white areas of which appear foggy.

Next, regarding the ratio in peripheral velocity between the photosensitive drum 1 and development roller 10, in order to satisfactorily charge the toner (developer) by utilizing the friction between the toner and photosensitive drum 1, and between the toner and development roller 10, the ratio is desired to be no less than 110%. On the other hand, if the ratio is set to a value greater than 150%, the mechanical stress to which the toner is subjected in the area of contact between the photosensitive drum 1 and development roller 10 becomes excessive, making it possible for the toner to drastically deteriorate.

For the reason given above, the ratio between the peripheral velocity of the photosensitive drum 1 and the peripheral velocity of the development roller 10 is desired to be in a range of 110-150%. In this embodiment, it was set to 140%.

Next, the developer regulating member 7 will be described.

The toner on the peripheral surface of the development roller 10 is regulated by the developer regulating member 7, which is disposed so that it is pressed upon the peripheral surface of the development roller 10. The developer regulating member 7 in this embodiment is in the form of a blade (development blade). Thus, as the development roller 10 is rotated while bearing the toner, a layer of toner, which is uniform in thickness, is formed on the peripheral surface of the development roller 10 by the developer regulating member 7.

The developer supplying member 12 is rotatably supported so that it remains in contact with the peripheral surface of the development roller 10, on the upstream side of the area of contact between the developer regulating member 7 and development roller 10 in terms of the rotational direction of the development roller 10.

Because the developing apparatus 6 is structured as described above, and also, from the standpoint of supplying the development roller 10 with developer, and stripping the unused developer from the development roller 10, a roller made of foamed sponge, or a fur brush made up of a metallic core, and fiber, such as rayon, nylon, or the like, planted on the peripheral surface of the metallic core, is desirable as the developer supply roller 12.

The developer supply roller 12 in this embodiment is a roller made up of a metallic core, and a urethane foam roller fitted around the metallic core. The width of the area of contact between the elastic supply roller 12 and development sleeve 10 is desired to be in a range of 1-8 mm. In this embodiment, the width of the area of contact was set to 3 mm. The supply roller 12 was rotationally driven.

In this embodiment, the electric power sources (supply roller bias electric power source apparatus 112, and development bias electric power source apparatus 110) are controlled by a CPU 60 (controlling apparatus) with which the main assembly 100A of the image forming apparatus 100 is provided.

More specifically, the CPU 60 controls the electric power source apparatuses 110 and 112, based on the absolute value S of the difference in peripheral velocity between the photosensitive drum 1 and development roller 10 (difference between peripheral velocity Sopc of image bearing member and peripheral velocity Sdr of developer bearing member; $S=|Sopc-Sdr|$), which is stored in advance in the memory portion of the apparatus. That is, the CPU 60 functions as the means which controls the supply roller bias power source apparatus 112 and development bias power source apparatus 110, based on the absolute value S of the abovementioned difference in peripheral velocity, to select or switch the potential level difference V ($V=Vrs-Vdr$) between the voltage Vrs (voltage applied to the supply roller 12) and the voltage Vdr (voltage applied to the development roller 10).

The image forming apparatus 100 in this embodiment is enabled to operate in two or more speeds to deal with various recording (printing) media.

Referring to Table 1, in a case where the image forming apparatus 100 is varied in printing speed while the peripheral velocity ratio between its photosensitive drum 1 and development roller 10 is kept at 140%, the slower the printing speed, the smaller the absolute value S of the peripheral velocity difference between the photosensitive drum 1 and development roller 10. As described above, the smaller the absolute value S of the peripheral velocity difference between the photosensitive drum 1 and development roller 10, the worse the fog is likely to be. This is why the peripheral velocity difference V is controlled by the CPU 60, based on the preset table.

More concretely, in the case where the potential level difference V is greater than 0 ($V>0$), a control is executed so that as the absolute value S of the peripheral velocity difference reduces, the potential level difference V reduces in absolute value, or reverses in polarity. On the other hand, in the case where the potential level difference V is no greater than 0 ($V\leqq 0$), a control is executed so that as the peripheral velocity difference reduces in absolute value S, the potential level difference V increases in absolute value while remaining the same in polarity. In this embodiment, a toner which is inherently negative in polarity is used. If a toner which is inherently positive in polarity is used, the sign of inequality given above has to be reversed in direction.

That is, according to the present invention, Vdr and Vrs are controlled in such a manner that the smaller the absolute value S of the peripheral velocity difference becomes, the larger Vrs becomes relative to Vdr while remaining the same in polarity as the developer (toner).

With Vdr and Vrs being controlled as described above, it is possible to prevent the development roller 10 from drastically deteriorating, and therefore, it is possible to form a high quality image, that is, an image which does not appear foggy.

The controlling method in Table 1 is to be selected based on the degree of worsening of the fog, and the state and/or amount of toner adhesion to the development roller 10. It should be noted here that the controlling method is to be selected according to the characteristics of the image forming apparatus, developing apparatus, and developer, which are used for image formation, and therefore, it does not need to be limited to those in Table 1.

TABLE 1

| | D. Per. Speed (mm/s) | R. Per. Speed (mm/s) | Per. Speed Ratio (%) | Speed Diff. (mm/s) | SR. Bias Vol. (V) | Dv. Bias Vol. (V) | Pot. Diff. (V) |
|---|---|---|---|---|---|---|---|
| Coated paper | 50 | 70 | 140 | 20 | −400 | −200 | −200 |
| Thick paper | 100 | 140 | 140 | 40 | −300 | −200 | −100 |
| Normal paper | 200 | 280 | 140 | 80 | −150 | −200 | 50 |
| Thin paper | 250 | 350 | 140 | 100 | −100 | −200 | 100 |

The direction of the same polarity as the polarity of the charged toner corresponds the direction from the bottom to the top of this table.

The selections of controlling methods in Table 1 are for the case in which the development bias remains at a preset level. However, control may be executed while varying the development bias within a range in which an image forming apparatus is not affected in terms of the image properties, such as image density. Given in Table 2 are the examples of controlling methods for such a case.

TABLE 2

| | D. Per. Speed (mm/s) | R. Per. Speed (mm/s) | Per. Speed Ratio (%) | Speed Diff. (mm/s) | SR. Bias Vol. (V) | Dv. Bias Vol. (V) | Pot. Diff. (V) |
|---|---|---|---|---|---|---|---|
| Coated paper | 50 | 70 | 140 | 30 | −300 | −100 | −200 |
| Thick paper | 100 | 140 | 140 | 40 | −250 | −200 | −50 |
| Normal paper | 200 | 280 | 140 | 80 | −250 | −300 | 50 |
| Thin paper | 250 | 350 | 140 | 100 | −280 | −350 | 70 |

The direction of the same polarity as the polarity of the charged toner corresponds the direction from the bottom to the top of this table.

As described above, according to the present invention, in the case where the peripheral velocity difference changes in such a direction that its absolute value S decreases, the image forming apparatus is controlled so that the potential level difference increases in value while remaining the same in polarity as the developer (toner). With the employment of this control, it is possible to uninterruptedly supply the developer bearing member with the developer which is high in the amount of electric charge, and therefore, it is possible to enable an image forming apparatus to continuously output high quality images, that is, images which do not suffer from fog, for a long time, while preventing the developer bearing member from excessively deteriorating.

Embodiment 2

Next, referring to FIG. 5, the image forming apparatus in the second preferred embodiment of the present invention will be described.

Incidentally, the structural features of the image forming apparatus in this embodiment, which are the same as the counterparts of the image forming apparatus in the first embodiment, will not be described.

This preferred embodiment is different from the first preferred embodiment in that in this embodiment, a difference in potential level is provided between the developer regulating member 7 and development roller 10, and also, in that in this embodiment, the peripheral velocity ratio between photosensitive drum 1 and development roller 10 is set to 120%.

First, the development blade 7, which is the developer regulating member, will be described.

The developer regulating member 7, which in this embodiment is a development blade, is disposed so that it is kept pressed upon the peripheral surface of the development roller 10. The toner on the development roller 10 is regulated by the development blade 7 in the amount by which it is allowed to remain adhered to the peripheral surface of the development roller 10 per unit area. That is, the developer regulating member 7 contributes to the formation of a uniform toner layer, the thickness of which is preset.

In order to regulate the amount by which toner is allowed to remain adhered to the development roller 10, the regulating member 7 is made different in potential level from the body of toner, which passes through the gap between the development roller 10 and developer regulating member 7. In this embodiment, therefore, at least the portion of the regulating member 7, which contacts the toner on the development roller 10, is made of an electrically conductive substance; the regulating member in this embodiment is a metallic member, an electrically conductive elastic member, a metallic blade covered with an electrically conductive surface layer, or the like.

In this embodiment, the electric power source apparatuses (development blade bias power source apparatus 107 and development bias electric source apparatus 110), with which the image forming apparatus 100 is provided, are controlled by the CPU 60 of the main assembly 100A of the image forming apparatus 100.

That is, the CPU 60 controls the electric power source apparatuses 107 and 110, based on the absolute value S ($S=|Sopc-Sdr|$) of the difference between the peripheral velocity of the photosensitive drum 1 (peripheral velocity Sopc of image bearing member) and the peripheral velocity of the development roller 10 (peripheral velocity Sdr of image bearing member). That is, the CPU 60 functions as the means which sets or switches the potential level difference V' ($V'=Vdb-Vdr$) between the voltage (Vdb) applied to the developer regulating member 7 and the voltage (Vdr) applied to the development roller 10, by controlling the development blade bias electric power source apparatus 107 and the development bias electric power source apparatus 110, based on the absolute value S of the peripheral velocity difference.

In this embodiment, in order to deal with various printing media, the image forming apparatus 100 is enabled to be operated in two or more printing speed modes.

Referring to Table 3, in the case where the image forming apparatus 100 in this embodiment is varied in printing speed while the peripheral velocity ratio between its photosensitive drum 1 and development roller 10 is maintained at 120%, the slower the printing speed, the smaller the absolute value S of the peripheral velocity difference between the photosensitive drum 1 and development roller 10. The smaller the absolute value S of the peripheral velocity difference, the worse the fog is likely to be, as described above. Therefore, the potential level difference V' is set to one of the preset values, in response to the changes in the absolute value S of the peripheral velocity difference.

More concretely, in the case where the potential level difference V' is greater than 0 ($V'>0$), a control is executed so that as the absolute value S of the peripheral velocity difference reduces, the potential level difference V' reduces in absolute value, or reverses in polarity. On the other hand, in the case where the potential level difference V' is no more than 0 ($V'<0$), a control is executed so that as the peripheral velocity difference reduces in absolute value S, the potential level difference V' increases in absolute value while remaining the same in polarity as the toner.

In this embodiment, a toner, which is negative in the polarity to which it is inherently chargeable, is used. However, in the case where a toner, which is positive in terms of the polarity to which it is inherently chargeable, is used, the sign of inequality in the inequality given above has to be reversed in direction.

That is, in this embodiment, Vdr and Vdb are controlled so that the smaller the absolute value S of the peripheral velocity difference, the greater in value Vdb relative to Vdr while remaining the same in polarity as the developer (toner).

Which of the controlling methods in Table 3 is selected is to be determined based on the degree of deterioration of the image forming apparatus 100 in terms of the fog, and the state and amount of the toner adhesion to the development roller 10. That is, the selection does not need to be limited to those given in Table 3; the selections may be modified according to the characteristics of the image forming apparatus, developing apparatus, and developer (toner) which are employed for an image forming operation.

With the control mode selected as described above, it is possible to form high quality images, that is, images which are free of fog, without causing the developer bearing member to abnormally deteriorate, regardless of the absolute value of the peripheral velocity difference between the photosensitive drum 1 and development roller 10.

TABLE 3

| | D. Per. Speed (mm/s) | R. Per. Speed (mm/s) | Per. Speed Ratio (%) | Speed Diff. (mm/s) | Bld. Bias Vol. (V) | Dv. Bias Vol. (V) | Pot. Diff. (V) |
|---|---|---|---|---|---|---|---|
| Coated paper | 50 | 60 | 120 | 10 | −400 | −200 | −200 |
| Thick paper | 100 | 120 | 120 | 20 | −300 | −200 | −100 |
| Normal paper | 200 | 240 | 120 | 40 | −250 | −200 | −50 |
| Thin paper | 250 | 300 | 120 | 50 | −150 | −200 | 50 |

The direction of the same polarity as the polarity of the charged toner corresponds the direction from the bottom to the top of this table.

The control mode selections given in Table 3 are the examples when the development bias is kept (remains) stable. However, the development bias may be varied within a range in which the image forming apparatus is not affected in terms of the image density. The controlling method selections given in Table 4 are the examples when the development bias is varied.

TABLE 4

| | D. Per. Speed (mm/s) | R. Per. Speed (mm/s) | Per. Speed Ratio (%) | Speed Diff. (mm/s) | Bld. Bias Vol. (V) | Dv. Bias Vol. (V) | Pot. Diff. (V) |
|---|---|---|---|---|---|---|---|
| Coated paper | 50 | 60 | 120 | 10 | −280 | −130 | −150 |
| Thick paper | 100 | 120 | 120 | 20 | −250 | −150 | −100 |
| Normal paper | 200 | 240 | 120 | 40 | −250 | −200 | −50 |
| Thin paper | 250 | 300 | 120 | 50 | −220 | −250 | 30 |

The direction of the same polarity as the polarity of the charged toner corresponds the direction from the bottom to the top of this table.

As described above, in this embodiment, control is executed so that as the absolute value S of the peripheral velocity difference reduces, the potential level difference V' increases while remaining the same in polarity as the developer (toner). With the employment of this controlling method, it is possible to uninterruptedly supply the developer regulating member (development blade) with developer (toner) which is large in the amount of electric charge, and therefore, to form high quality images, that is, images which are free of fog, without causing the developer bearing member to excessively deteriorate, regardless of how the image forming apparatus is used by a user, and the environment in which the apparatus is used.

Embodiment 3

In the description of the second preferred embodiment, it was stated that it was possible to prevent the formation of a foggy image by controlling the potential level difference V' based on the absolute value S of the peripheral velocity difference. This method is such a method that improves the image forming apparatus 100 in terms of the distribution of the amount of toner charge on the development roller 10, on the downstream side of the developer regulating member 7 (development blade). This method is effective to control an image forming apparatus by an electric field, in terms of the distribution of the amount of charge across the toner layer formed by the developer regulating member 7 as the toner particles are randomly put through the interface between the developer regulating member 7 and development roller 10. However, it is possible that the amount of charge, with which toner is provided, and/or which toner has, will be affected by how an image forming apparatus is used, and/or the environment in which the apparatus is used.

In this embodiment, therefore, in order to stabilize an image forming apparatus in terms of the amount of toner charge regardless of how the apparatus is used and/or the environment in which the apparatus is used, the apparatus is improved in terms of the distribution of toner particles in terms of amount of charge, on the upstream side of the developer regulating member 7 in terms of the rotational direction of the development roller 10.

Figure 7:
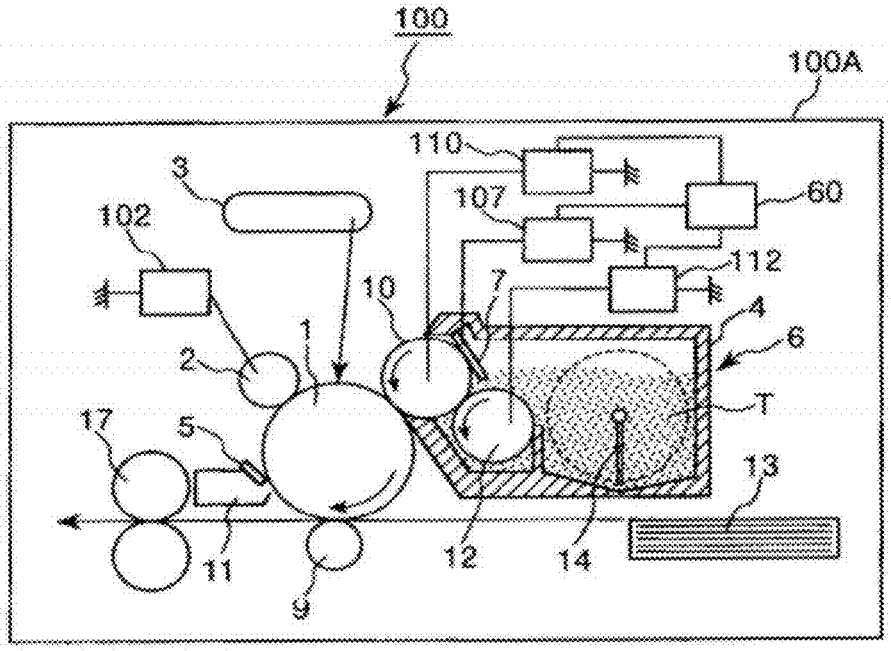
FIG. 7 is a schematic sectional view of the image forming apparatus in the third preferred embodiment of the present invention, and shows the general structure of the apparatus.

FIG. 7 shows the structure of the image forming apparatus 100 in this embodiment. The overall structure of the image forming apparatus 100 in this embodiment is the same as that of the image forming apparatus in the second preferred embodiment, and therefore, will not be described in detail; it is suggested to utilize the description of the image forming apparatus 100 in the second preferred embodiment.

The image forming apparatus 100 in this embodiment, however, is different from the image forming apparatus 100 in the second preferred embodiment in that it is provided with a supply roller bias power source apparatus 112, which is controlled along with the development blade bias power source apparatus and development bias power source apparatus, by the CPU 60, with which the main assembly 100A of the apparatus 100 is provided.

Figure 5:
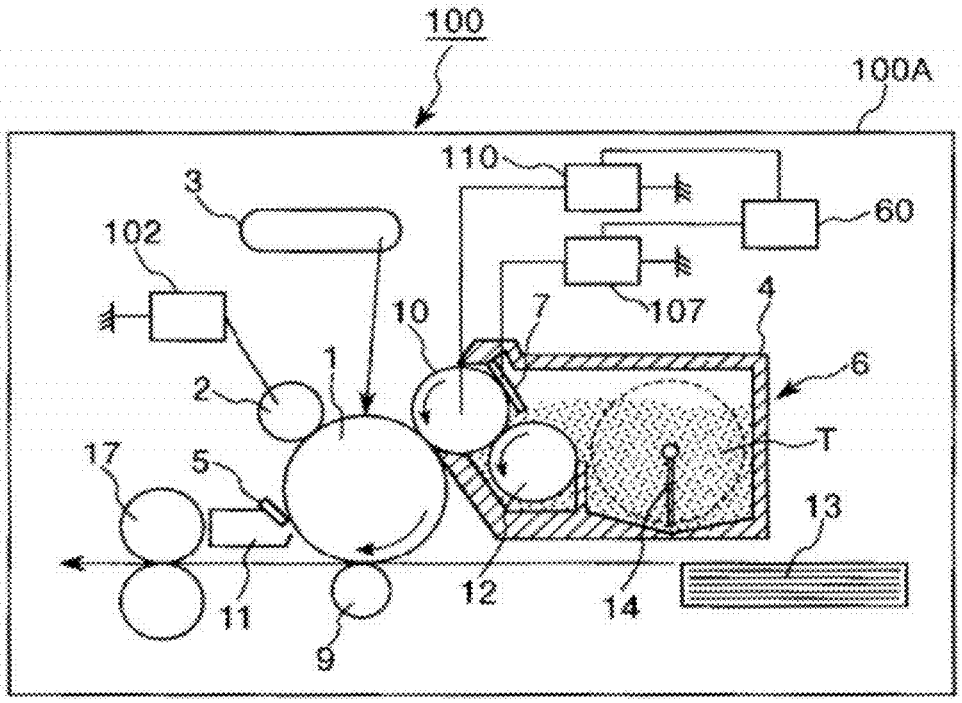
FIG. 5 is a schematic sectional view of the image forming apparatus in the second preferred embodiment of the present invention, and shows the general structure of the apparatus.
Figure 6:
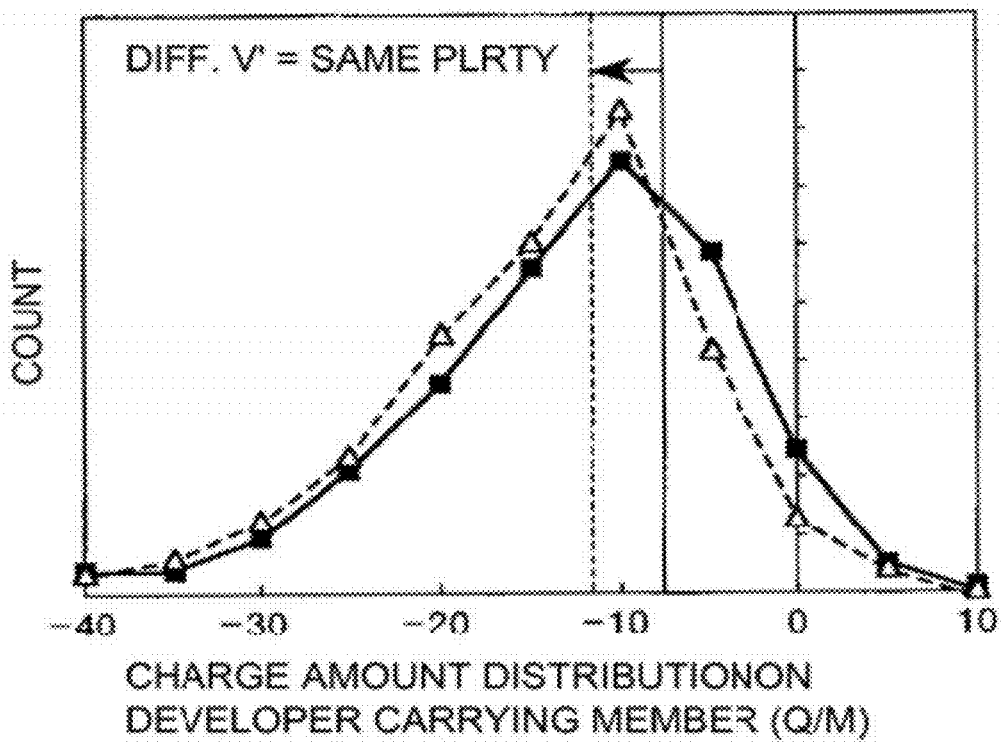
FIG. 6 is a graph which shows the relationship between the potential level different V', and the developer (toner) particle distribution on the developer bearing member in terms of the amount of charge, on the immediate downstream side of the developer regulating member in terms of the rotational direction of the developer bearing member.

Referring to FIG. 5, it was confirmed, by the studies made by the inventors of the present invention, that as the voltage (Vrs) to be applied to the supply roller is increased relative to the voltage (Vdr) to be applied to the development roller, while being kept the same in polarity as the toner, the toner particles on the supply roller 12, which are greater in the amount of charge, are selectively supplied to the development roller 10, whereby the distribution of toner particles on the development roller 10 in terms of the amount of charge is significantly shifted in the toner polarity direction (negative in this embodiment). In the following description of this embodiment, V stands for potential level difference (first potential difference) between the voltage applied to the development roller and the voltage applied to the developer supply roller (V=Vrs−Vdr), and V' stands for the potential level difference (second potential level difference) between the voltage applied to the development blade and the voltage applied to the development roller (V'=Vdb−Vdr).

Shown in Table 5 are examples of the controls in this embodiment.

More concretely, in the case where the potential level V' is greater than 0 (V'>0), a control is executed so that as the absolute value S of the peripheral velocity difference reduces, V' reduces in absolute value, or reverses in polarity.

On the other hand, in the case where V' is no less than 0 (V'<0), a control is executed so that as the absolute value S of the peripheral velocity difference reduces, V' increases in absolute value while remaining the same in polarity as the toner.

In the case where V is no less than 0 (V>0), a control is executed so that as the absolute value S of the peripheral velocity difference reduces, V reduces in absolute value, or reverses in polarity. On the other hand, in the case where the potential level difference V is no less than 0 (V<0), a control is executed so that as the absolute value S of the peripheral velocity difference reduces, the potential level difference V increases in absolute value while remaining the same in polarity as the toner. In this embodiment, a toner, which is negative in inherent polarity is used. However, a toner which is positive in inherent polarity may be used. In the case where a toner which is positive in inherent polarity is used, the sign of inequality in the inequality given above, becomes reverse in direction.

That is, in this embodiment, Vdr, Vdb, and Vrs are controlled so that as the absolute value S of the peripheral velocity difference reduces, Vdb and Vrs become larger relative to Vdr while remaining the same in polarity as the developer (toner).

As described above, a control is executed so that as the absolute value S of the peripheral velocity difference reduces, the first potential level differences V and second potential level difference V' increases while remaining the same in polarity as the toner. With the employment of this controlling method, it is possible to uninterruptedly supply the developer blade 7 with toner particles which are large in the amount of charge, and therefore, it is possible to form high quality images, that is, images which are free of fog, for a long time, without abnormally deteriorating the developer bearing member, regardless of how the apparatus is used by a user, and/or the environment in which the apparatus is used.

Shown in Table 5 are examples of the method for controlling the first potential level difference V and second potential level difference V'. Which of the controlling methods in Table 5 is selected is to be determined based on the degree of deterioration of the image forming apparatus 100 in terms of the fog, and the state and amount of the toner adhesion to the development roller 10. That is, the selection does not need to be limited to those given in Table 5; the selections may be modified according to the characteristics of the image forming apparatus, developing apparatus, and developer (toner) which are employed for an intended image forming operation.

TABLE 5

| | D. Per. Speed (mm/s) | R. Per. Speed (mm/s) | Per. Speed Ratio (%) | Spd Diff. (mm/s) | S.R Bias Vol. (V) | Dv.. Bias Vol. (V) | Bld. Bias Vol. (V) | Pot. Diff. V | Pot. Diff. V' |
|---|---|---|---|---|---|---|---|---|---|
| Coated paper | 50 | 60 | 120 | 10 | −500 | −150 | −350 | −350 | −200 |
| Thick paper | 100 | 120 | 120 | 20 | −400 | −200 | −300 | −200 | −100 |
| Normal paper | 200 | 240 | 120 | 40 | −200 | −200 | −250 | 0 | −50 |
| Thin paper | 250 | 300 | 120 | 50 | −200 | −250 | −220 | 50 | 30 |

The direction of the same polarity as the polarity of the charged toner corresponds the direction from the bottom to the top of this table.

Incidentally, in the preferred embodiments described above, the image forming apparatus 100 was controlled so that the peripheral velocity ratio between the photosensitive drum 1 and development roller 10 remains the same. However, this is not mandatory. That is, the peripheral velocity ratio of the photosensitive drum 1 and development roller 10 may be varied by providing each of the photosensitive drum 1 and development roller 10 with its own driving power source.

Further, in the preceding preferred embodiments of the present invention, which were described above, the image forming apparatuses were of the so-called contact development type, that is, image forming apparatuses, the development roller 10 and photosensitive drum 1 of which make contact with each other. However, these embodiments were not intended to limit the present invention in scope. That is, the present invention is also applicable to an image forming apparatus of the so-called non-contact development type, that is, image forming apparatus, the development roller 10 and photosensitive drum 1 of which make no contact with each other.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Applications Nos. 221986/2008, 222002/2008 and 193682/2009 filed Aug. 29, 2008, Aug. 29, 2008 and Aug. 24, 2009, which is hereby incorporated by reference.

What is claimed is:

1. An image forming apparatus comprising:

an image bearing member for bearing an electrostatic latent image;

a developing device including:

(i) a developer carrying member for carrying a developer and developing an electrostatic latent image formed on the image bearing member, and (ii) a supplying member for contacting the developer carrying member to supply the developer to the developer carrying member, wherein a peripheral speed Sopc of a surface of the image bearing member and a peripheral seed Sdr of a surface of the developer carrying member change while a ratio therebetween is maintained; and a control device for controlling a voltage Vrs applied to the supplying member and a voltage Vdr applied to the developer carrying member such that the voltage Vrs relative to the voltage Vdr increases, with a decrease in an absolute value of a difference between the peripheral speed Sopc and the peripheral speed Sdr, in a direction of a polarity which is the same as a polarity of the developer, while maintaining the ratio between the peripheral speed Sopc and the peripheral speed Sdr.

2. An apparatus according to claim 1, wherein the developing device is configured to be mountable to and demountable from a main assembly of the image forming apparatus.

3. An apparatus according to claim 1, wherein at least the image bearing member and the developing device comprise a unit which is configured to be detachably mountable to a main assembly of the image forming apparatus.

4. An image forming apparatus comprising:

an image bearing member for bearing an electrostatic latent image;

a developing device including:

(i) a developer carrying member for carrying a developer and developing an electrostatic latent image formed on the image bearing member, and (ii) a developer regulating member for regulating an amount of the developer deposited on the developer carrying member while contacting the deposited developer, wherein at least a part of developer regulating member contacting the developer is made of electroconductive material, and wherein a peripheral speed Sopc of a surface of the image bearing member and a peripheral speed Sdr of a surface of the developer carrying member while a ratio therebetween is maintained; and a control device for controlling a voltage Vdr applied to the developer carrying member and a voltage Vdb applied to the developer regulating member such that the voltage Vdb relative to the voltage Vdr increases, with a decrease in an absolute value of a difference between the peripheral speed Sopc and the peripheral speed Sdr, in a direction of a polarity which is the same as a polarity of the developer, while maintaining the ratio between the peripheral speed, the peripheral speed Sdr with.

5. An apparatus according to claim 4, wherein the developing device is configured to be mountable to and demountable from a main assembly of the image forming apparatus.

6. An apparatus according to claim 4, wherein at least the image bearing member and the developing device comprise a unit which is configured to be detachably mountable to a main assembly of the image forming apparatus.

7. An image forming apparatus comprising:

an image bearing member for bearing an electrostatic latent image;

a developing device including:

(i) a developer carrying member for carrying a developer and developing an electrostatic latent image formed on the image bearing member, (ii) a supplying member for contacting the developer carrying member to supply the developer to the developer carrying member, and (iii) a developer regulating member for regulating an amount of the developer deposited on the developer carrying member while contacting the deposited developer, wherein at least a part of developer regulating member contacting the developer is made of electroconductive material, and wherein a peripheral speed Sopc of a surface of the image bearing member and a peripheral speed Sdr of a surface of the developer carrying member change while a ratio therebetween is maintained; and a control device for controlling a voltage Vdr applied to the developer carrying member, a voltage Vdb applied to the developer regulating member, and a voltage Vrs applied to the supplying member, such that the voltage Vdb and the voltage Vrs relative to the voltage Vdr increase, with a decrease in an absolute value of a difference between the peripheral speed Sopc and the peripheral speed Sdr, in a direction of a polarity which is the same as a polarity of the developer, while maintaining the ratio between the peripheral speed Sopc and the peripheral speed Sdr.

8. An apparatus according to claim 7, wherein the developing device is configured to be mountable to and demountable from a main assembly of the image forming apparatus.

9. An apparatus according to claim 7, wherein at least the image bearing member and the developing device comprise a unit which is configured to be detachably mountable to a main assembly of the image forming apparatus.

* * * * *